US010662730B2

(12) United States Patent
Mireles et al.

(10) Patent No.: US 10,662,730 B2
(45) Date of Patent: May 26, 2020

(54) BLOWOUT PREVENTER PACKING ASSEMBLY

(71) Applicant: National Oilwell Varco, L.P., Houston, TX (US)

(72) Inventors: Lydia Mata Mireles, Houston, TX (US); Sergio Garcia, Spring, TX (US); Nathan Follett, Houston, TX (US)

(73) Assignee: National Oilwell Varco, L.P., Houston, TX (US)

( * ) Notice: Subject to any disclaimer, the term of this patent is extended or adjusted under 35 U.S.C. 154(b) by 17 days.

(21) Appl. No.: 15/752,875

(22) PCT Filed: Aug. 10, 2016

(86) PCT No.: PCT/US2016/046249
§ 371 (c)(1),
(2) Date: Feb. 14, 2018

(87) PCT Pub. No.: WO2017/030847
PCT Pub. Date: Feb. 23, 2017

(65) Prior Publication Data

US 2018/0245419 A1 Aug. 30, 2018

Related U.S. Application Data

(60) Provisional application No. 62/205,151, filed on Aug. 14, 2015.

(51) Int. Cl.
*E21B 33/06* (2006.01)
*E21B 33/00* (2006.01)

(52) U.S. Cl.
CPC ..... *E21B 33/06* (2013.01); *E21B 2033/005* (2013.01)

(58) Field of Classification Search
CPC ..... E21B 33/06; E21B 33/005
USPC ..... 251/1.2, 1.3; 166/363, 364
See application file for complete search history.

(56) References Cited

U.S. PATENT DOCUMENTS 2,496,154 A * 1/1950 Fermier ..... E21B 33/0422 277/320
2,760,750 A * 8/1956 Schweitzer, Jr. ..... E21B 33/06 166/84.4
2,812,197 A * 11/1957 Gibson ..... E21B 33/06 277/327
2,832,617 A * 4/1958 Gibson ..... E21B 33/06 277/327

(Continued)

OTHER PUBLICATIONS

International Patent Application No. PCT/US2016/046249 International Search Report and Written Opinion dated Oct. 24, 2016 (11 pages).

(Continued)

*Primary Examiner* — Umashankar Venkatesan
(74) *Attorney, Agent, or Firm* — Conley Rose, P.C.

(57) ABSTRACT

A blowout preventer is disclosed that includes a housing defining a central passage. The central passage is configured to receive a tubular string therethrough. In addition, the blowout preventer includes a packing element disposed in the central passage. The packing element includes an elastomeric member, and a rigid insert mounted to the elastomeric member. The insert includes an extendable tip assembly configured to extend a movable member away from the rigid insert.

22 Claims, 9 Drawing Sheets

(56) References Cited

U.S. PATENT DOCUMENTS

| | | | | | |
|---|---|---|---|---|---|
| 2,846,178 | A | * | 8/1958 | Minor | E21B 33/06 166/80.1 |
| 3,897,040 | A | * | 7/1975 | Le Rouax | E21B 33/06 166/84.4 |
| 3,915,424 | A | | 10/1975 | LeRouax | |
| 4,095,805 | A | * | 6/1978 | Allen | E21B 33/06 251/1.1 |
| 4,358,085 | A | | 11/1982 | Regan et al. | |
| 4,605,195 | A | * | 8/1986 | Burton | E21B 33/06 251/1.2 |
| 4,858,882 | A | * | 8/1989 | Beard | E21B 33/06 251/1.2 |
| 4,949,785 | A | * | 8/1990 | Beard | E21B 33/06 166/196 |
| 5,116,017 | A | * | 5/1992 | Granger | E21B 33/06 251/1.2 |
| 5,662,171 | A | | 9/1997 | Brugman et al. | |
| 6,318,482 | B1 | | 11/2001 | Fidtje | |
| 2011/0226475 | A1 | | 9/2011 | Springett et al. | |
| 2012/0227987 | A1 | | 9/2012 | Castriotta | |
| 2015/0144356 | A1 | | 5/2015 | DeOcampo | |
| 2015/0275609 | A1 | | 10/2015 | Liotta | |
| 2018/0010410 | A1 | | 1/2018 | Jones | |
| 2018/0066492 | A1 | | 3/2018 | Arteaga | |

OTHER PUBLICATIONS

Search Report and Written Opinion for PCT/US2019/034401 dated Aug. 27, 2019 (13 pages).

* cited by examiner

BLOWOUT PREVENTER PACKING ASSEMBLY

CROSS-REFERENCE TO RELATED APPLICATIONS

This application is a 35 U.S.C. § 371 national stage entry of PCT/US2016/046249, filed Aug. 10, 2016, and entitled "Blowout Preventer Packing Assembly," which claims the benefit of U.S. provisional patent application Ser. No. 62/205,151 filed Aug. 14, 2015, and entitled "Blowout Preventer Packing Assembly," the contents of each are hereby incorporated herein by reference in their entirety.

STATEMENT REGARDING FEDERALLY SPONSORED RESEARCH OR DEVELOPMENT

Not applicable.

BACKGROUND

This disclosure generally relates to annular blowout preventers for use in connection with subterranean drilling and/or production operations. In particular, this disclosure relates to packing elements disposed within annular blowout preventers.

A blowout preventer (hereinafter "BOP") is a device that, when actuated, is configured to close off a wellbore during subterranean drilling or production operations (e.g., oil and gas drilling and production operations) to prevent an uncontrolled release or "blowout" of formation fluids at the surface (e.g., such as during a "kick" of uncontrolled, high pressure fluid migrating into the wellbore from the subterranean formation). One specific type of BOP, known as an annular blowout preventer ("annular BOP"), is designed to close off the annulus that exists between the borehole wall and any tools or tubing strings extending through wellbore, such that any fluid flow paths extending through the tools or tubing string remains open even after the annular BOP has been actuated.

BRIEF SUMMARY OF THE DISCLOSURE

Some embodiments disclosed herein are directed to a blowout preventer. In an embodiment, the blowout preventer includes a housing defining a central passage, wherein the central passage is configured to receive a tubular string therethrough. In addition, the blowout preventer includes a packing element disposed in the central passage. The packing element includes an elastomeric member and a rigid insert mounted to the elastomeric member. The insert comprises an extendable tip assembly configured to extend a movable member away from the rigid insert.

Other embodiments are directed to a packing element for a blowout preventer. In an embodiment, the packing element includes an elastomeric member and a rigid insert mounted to the elastomeric member. The rigid insert includes an extendable tip assembly configured to extend a movable member away from the rigid insert. The movable member is configured to limit deformation of the elastomeric member.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those skilled in the art upon reading the following detailed description, and by referring to the accompanying drawings. It should be appreciated that the conception and the specific embodiments disclosed may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of various exemplary embodiments, reference will now be made to the accompanying drawings in which.

DETAILED DESCRIPTION OF EXEMPLARY EMBODIMENTS

Figure 1:
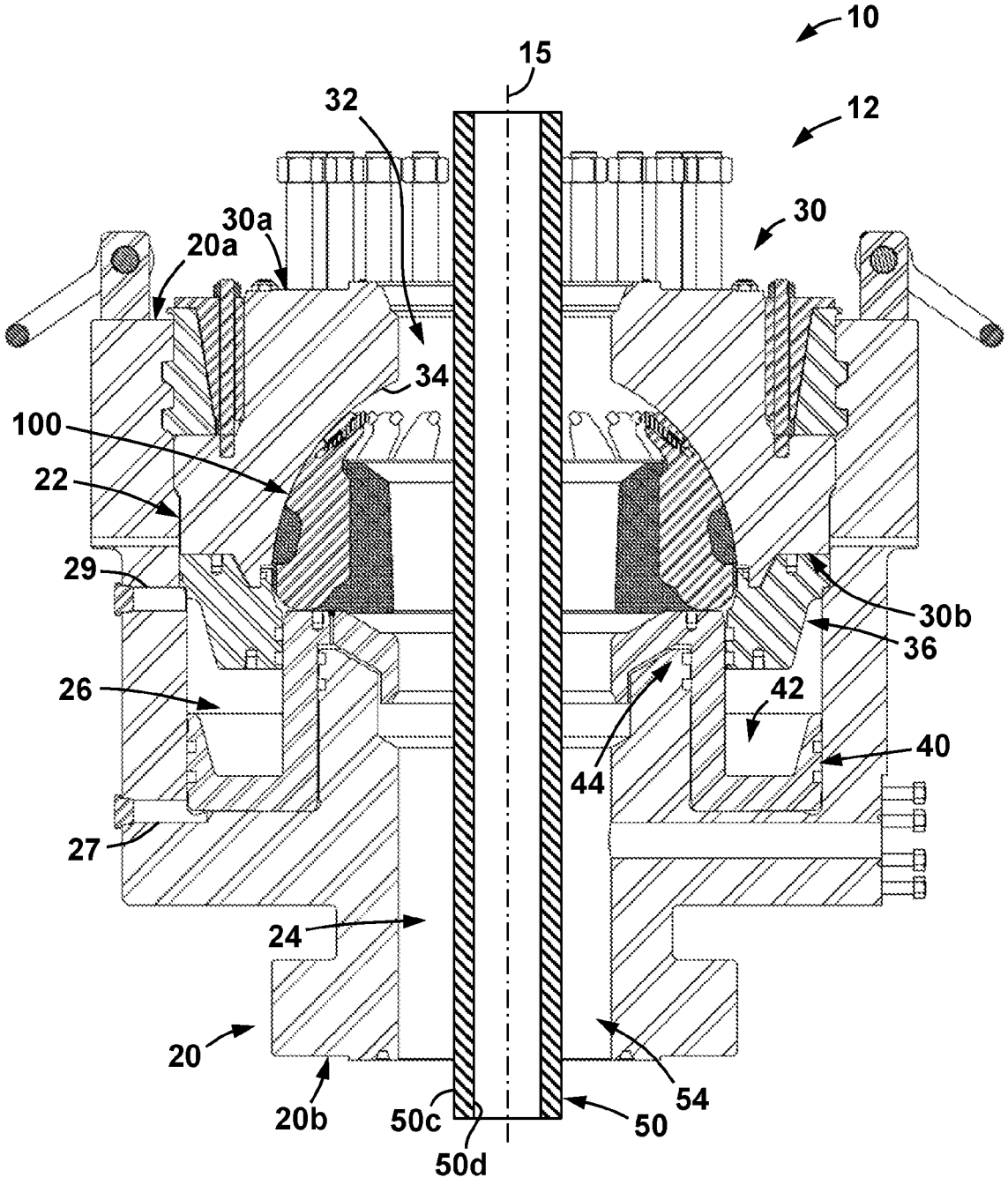
FIG. 1 is a side cross-sectional view of an annular BOP including a packing element in accordance with at least some embodiments.

The following discussion is directed to various exemplary embodiments. However, one of ordinary skill in the art will understand that the examples disclosed herein have broad application, and that the discussion of any embodiment is meant only to be exemplary of that embodiment, and not intended to suggest that the scope of the disclosure, including the claims, is limited to that embodiment.

The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ". Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis.

As described above, an annular BOP is designed to close off an annulus disposed between the wellbore and any tools or tubing strings extending therethrough. Annular BOPs typically include a packing element that comprises a plurality of metal inserts embedded within an annular or ring-shaped elastomeric member. Actuating the annular BOP includes radially compressing the packing element such that the elastomeric member deforms and encapsulates the tool or other equipment (e.g., tubular string) extending through the BOP.

During actuation of the annular BOP and deformation of the elastomeric packing element, the metal inserts provide structural support and thereby prevent excessive deformation of the elastomeric unit. The sizing of the metal inserts is often critical to the proper operation of the annular BOP. Specifically, the inserts must be large enough to provide sufficient support to the elastomeric member during deformation thereof, but must also be small enough so as not to impinge upon (and thus damage) equipment which may be extending through the annular BOP. As a result, the packing element installed within an annular BOP may not be sized to properly seal about equipment (e.g., a tubular string) extending through the wellbore. Replacement of the packing element for each differently sized piece of equipment that is run within the well is not practical, and may not be feasible in certain scenarios. Therefore, embodiments disclosed herein are directed to packing elements for annular BOPs that include metal inserts with extendable tip assemblies that may be actuated to change the effective size of the metal inserts, and thereby ensure that the packing element properly seals the annulus of the wellbore regardless of the size of equipment that may is extending through the wellbore at the time of actuation.

Referring now to FIG. 1, an annular BOP 10 in accordance with at least some embodiments is shown. BOP 10 generally includes a central or longitudinal axis 15, a body or housing 12, a piston 40 movably disposed within the housing 12, and a packing element 100 also disposed within housing 12.

Housing 12 includes a first or lower housing member 20, and a second or upper housing member 30. Lower housing member 20 includes a first or upper end 20*a*, a second or lower end 20*b* opposite upper end 20*a*, a central cavity 22 extending axially from upper end 20*a*, and a central through passage 24 extending axially from cavity 22 to lower end 20*b*. Upper housing member 30 includes a first or upper end 30*a*, a second or lower end 30*b* opposite upper end 30*a*, and a central through passage 32 extending axially through housing between ends 30*a*, 30*b*. Passage 32 includes and is partially defined by a concave spherical surface 34 extending from lower end 30*b*. In order to assemble housing 12, an adapter ring 36 is secured to lower end 30*b* of upper housing member 30 and upper housing member 30 is inserted axially within cavity 22 of lower housing member 20 such that upper end 30*a* of upper housing member 30 is disposed proximate upper end 20*a* of lower housing member 20. In addition, when upper housing member 30 is inserted axially within cavity 22 of lower housing member 20, passage 32 in upper housing member 30 is axially aligned and combined with passage 24 in lower housing member 20 to form a central passage 54 extending axially through housing 12. Packing element 100 is disposed within passage 54 axially above piston 40. In addition, as shown in FIG. 1, a tubular member 50 is shown extending through passage 54 along axis 15. Tubular member 50 may be any sort of downhole tubular or tool, and is merely schematically shown herein so as not to unduly complicate the figures. Specifically, as best shown in FIG. 1, tubular member 50 includes a radially outer cylindrical surface 50*c* and a radially inner cylindrical surface 50*d* that defines a throughbore 52 extending axially through member 50.

In addition, when upper housing 30 is received within cavity 22 of lower housing member 20, a remaining annular portion of cavity 22 that is not occupied by upper housing member 30 forms and defines an actuation chamber 26 that is annularly disposed about central passage 54. A pair of ports 29, 27 extends radially through lower housing member 20 into chamber 26 with a first or upper port 29 being positioned axially above a second or lower port 27. As will be explained in more detail below, to actuate BOP 10, pressurized fluid (e.g. hydraulic fluid) is routed through lower port 27 to cause actuation of piston 40 and therefore deformation of packing element 100.

Piston 40 is an annular or ring-shaped member that is disposed within both passage 54 and chamber 26 of housing 12. Piston 40 includes an actuation section 42 and an engagement section 44 extending axially from actuation section 42. Actuation section 42 is entirely disposed within actuation chamber 26, while engagement section 44 extends axially from chamber 26 into passage 54 of housing 12 where it engages with packing element 100. During operations, as previously mentioned above, a high pressure fluid (e.g., hydraulic fluid) is routed into lower port 27 which increases the pressure on an axially lower side of actuation section 42, and causes actuation section 42 of piston 40 to stroke axially upward within chamber 26. As piston 40 strokes upward in the manner described, any fluid (e.g., air, hydraulic fluid, water, etc.) disposed within chamber 26 that is axially above actuation section 42 is forced out of chamber 26 through upper port 29. In addition, as piston 40 strokes upward in the manner described, engagement section 44 translates axially upward within central passage 54 of housing 12. As can be appreciated from FIG. 1, upward movement of piston 40 is limited by adapter ring 36 secured to lower end 30*b* of upper housing member 30 such that at its upper limit, actuation section 42 of piston 40 engages with ring 36 within chamber 26.

Figure 2:
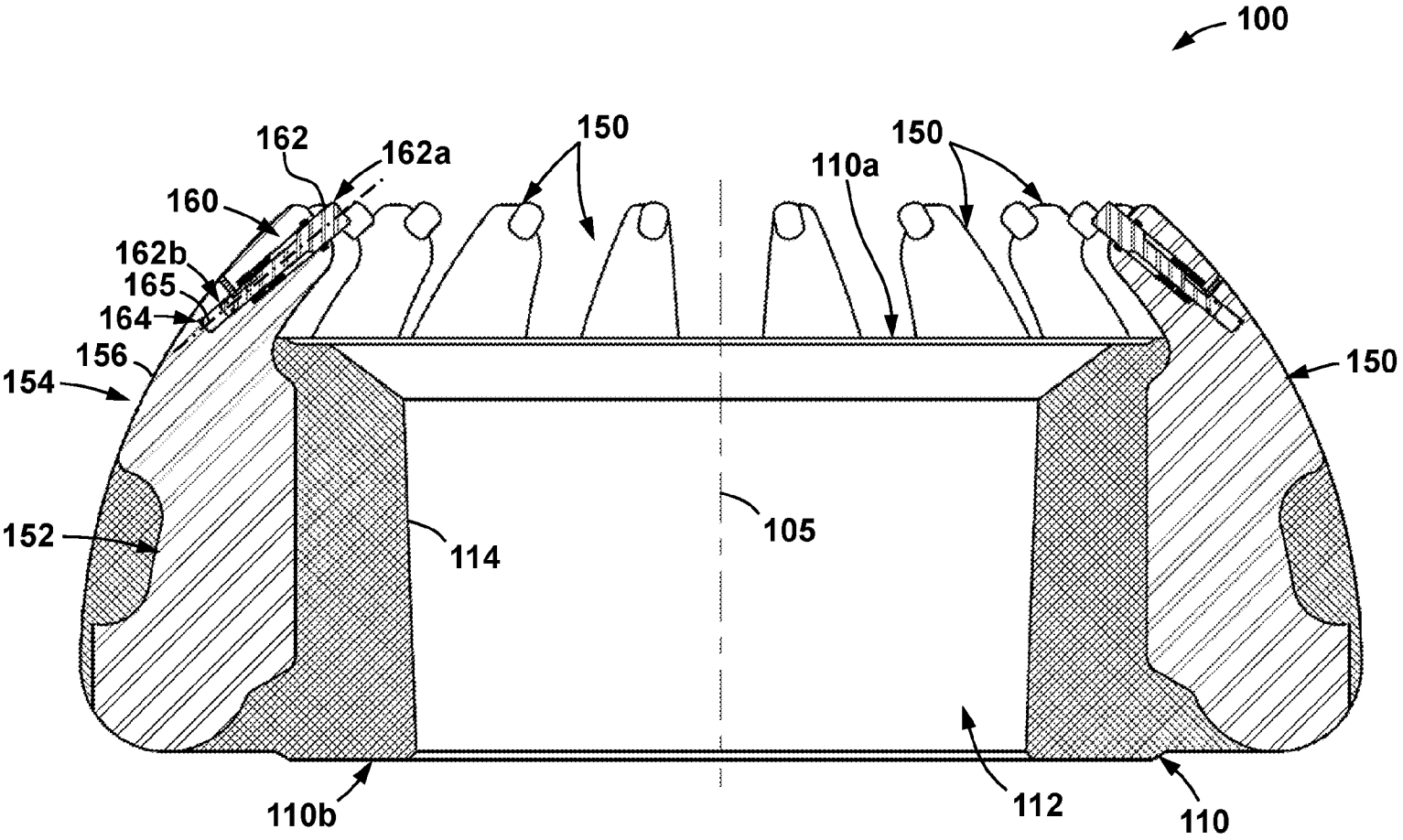
FIG. 2 is an enlarged side cross-sectional view of the packing element disposable within the BOP of FIG. 1.

Referring now to FIG. 2, packing element 100 is an annular or ring-shaped member that includes a central axis 105 that is generally aligned with axis 15 of BOP 10 during operations, an elastomeric member 110, and a plurality of rigid inserts 150 embedded within elastomeric member 110 and circumferentially arranged about axis 105. Elastomeric member 110 includes a first or upper end 110*a*, a second or lower end 110*b*, and a central throughbore 112 extending axially between ends 110*a*, 110*b* that is defined by a radially inner surface 114. Elastomeric member 110 may be constructed of any suitable material that may be deformed when placed under a load (e.g., a compressive load from piston 40), but then return to its original shape when the load is removed (i.e., any material which is elastically deformable). In some embodiments, member 110 may comprise rubber, which may include, for example, nitrile, natural rubber, hydrogenated nitrile butadiene rubber (HNBR), urethane, and/or silicone.

Referring still to FIG. 2, each rigid insert 150 includes a body 152, and an elongate support section 154. Body 152 is embedded within elastomeric member 110 while support section 154 extends outward from member 110 at upper end 110*a*. Support section 154 includes a radially outer curved surface 156 and an extendable tip assembly 160. As will be described in more detail below, when packing element 100 is installed within BOP 10, the curved outer surface 156 of each insert 150 slidingly engages the concave spherical surface 34 of central passage 54. Thus, in some embodiments, the curvature of outer surfaces 156 of inserts 150 substantially matches the curvature of surface 34 on upper housing member 30.

Extendable tip assembly 160 is disposed within support section 154 and includes a movable member 162 disposed within a recess or cavity 164 extending into support section 154 along an axis 165. Axis 165 is disposed at a non-zero angle with respect to central axis 105 and intersects a plane (not specifically shown) containing central axis 105. Movable member 162 includes a first or outer end 162*a* and a second or inner end 162*b* opposite outer end 162*a*. Member 162 is inserted within recess 164 such that outer end 162*a* extends from recess 164 along axis 165, and inner end 162*b* is disposed within recess 164. As will be described in more detail below, during operations, movable member 162 is actuated to extend outer end 162*a* out and away from recess 164 and generally toward axis 105 along axis 165 in order to provide support for elastomeric member 110 as it deforms both radially and axially with respect to axis 105 (and thus also axis 15 of BOP 10).

Figure 4:
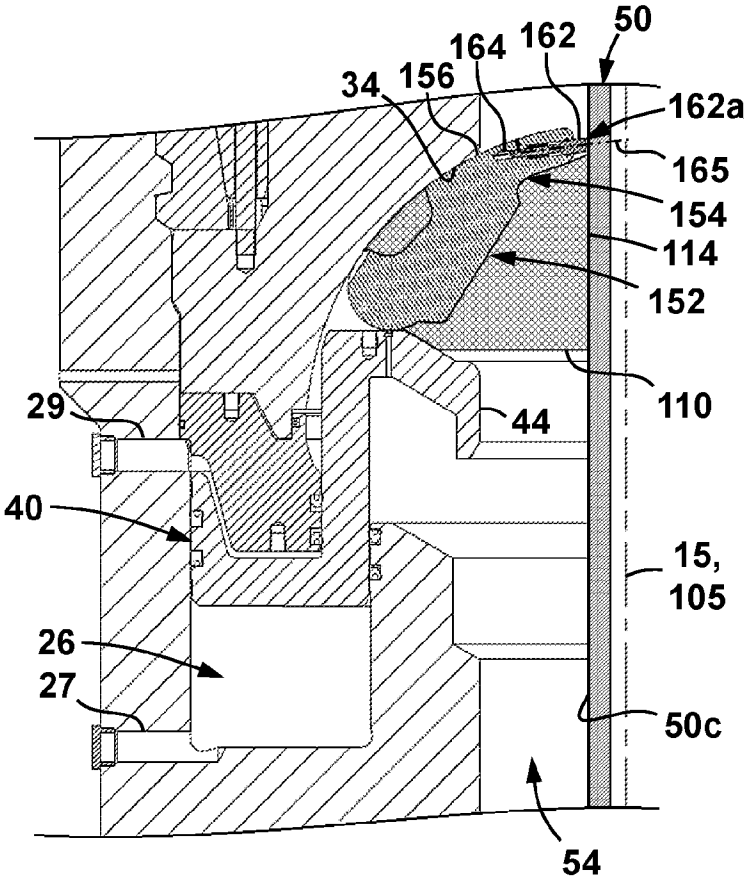
FIGS. 3 and 4 are side cross-sectional views of the BOP of FIG. 1 actuating about a tubular member.
Figure 3:
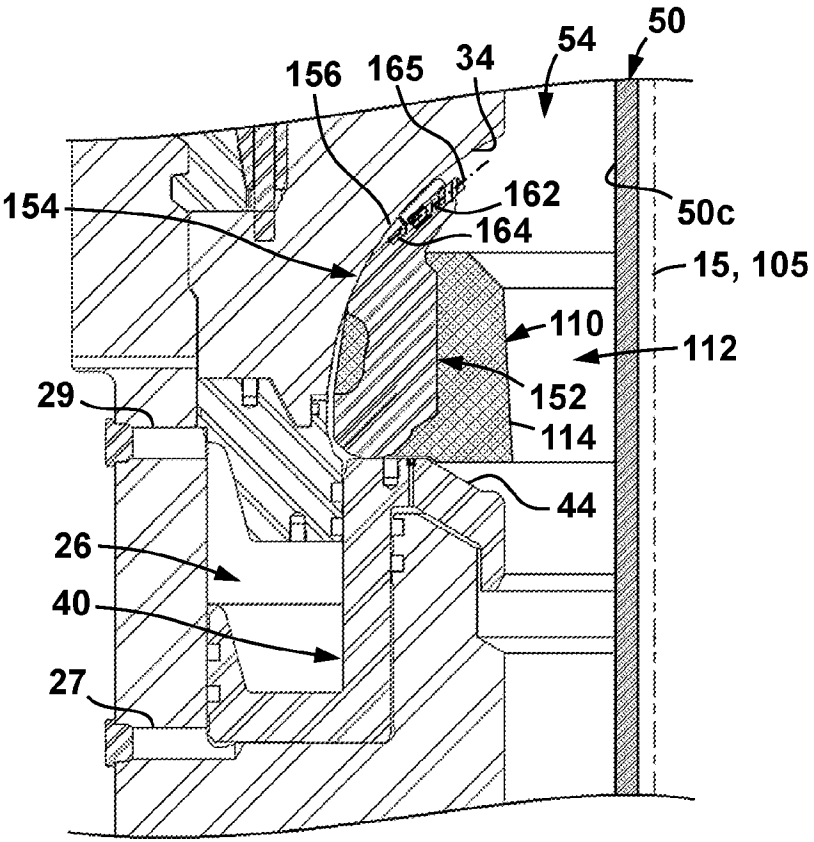

Referring specifically to FIGS. 3 and 4, during operations it may become desirable to close off the central passage 54 of BOP 10 (e.g., during an uncontrolled influx of formation fluids into the wellbore). Specifically, it may become desirable to close of the annulus formed between passage 54 and radially outer surface 50*c* of tubular member (e.g., so that the throughbore 52 extending through member 50 may still remain open). To actuate BOP 10 and therefore close off passage 54, actuation section 42 of piston 40 is actuated to move axially upward within actuation chamber 26 in the manner described above (i.e., by feeding pressurized fluid into chamber 26 through port 27). As is best shown in FIG. 4, as piston 40 strokes upward, engagement section 44 engages with packing element 100 and forces packing element 100 axially upward within central passage 54. This upward movement of packing element 100 facilitates sliding engagement between curved surfaces 156 on rigid inserts 150 and the concave spherical surface 34 which thereby causes a radially inward deflection of inserts 150 toward the aligned axes 15, 105 (note: only one insert 150 is shown in FIGS. 3 and 4 so as not to unduly complicate the figures). As shown in the progression from FIG. 3 to FIG. 4, the radial deflection of rigid inserts 150 further causes deformation of elastomeric element 110 both radially inward and axially upward within passage 54. Specifically, as shown in FIG. 4, elastomeric member 110 is deformed radially inward thereby decreasing the diameter of throughbore 112 until radially inner surface 114 sealingly engages or abuts radially outer surface 50*c* of member 50.

Referring still to FIGS. 3, and 4, as elastomeric element 110 is deformed in the manner described above, movable members 162 in extendable tip assemblies 160 are extended outward along the corresponding axes 165 to engage with the deforming elastomeric member 110 and thereby prevent excessive axial deformation or expansion of member 110 between support sections 154 and radially outer surface 50*c* of member 50. In some embodiments, movable members 162 are actuated to extend from recesses 164 until outer ends 162*a* engage with radially outer surface 50*c* without impinging or damaging the same. However, such contact between outer ends 162*a* and radially outer surface 50*c* is not required. Thus, by extending members 162 during actuation of BOP 10, the length of rigid inserts 150 may be adjusted to ensure proper support for elastomeric member 110 regardless of the size of the tool(s) or tubular(s) that may be extending through central passage 54.

Once it becomes desirable to re-open the annulus about tubular member 50 within passage 54 (FIG. 1), fluid pressure is reduced or released in port 27 to allow piston 40 and packing element 100 to fall axially downward under the force of gravity. As piston 40 and element 100 translate axially downward (or toward lower end 20*b* of lower housing member 20), radially outer curved surfaces 156 on inserts 150 again slidingly engage with concave spherical surface 34 in passage 54 and allow both inserts 150 and elastomeric member 110 of packing element 100 to radially expand to their original positions shown in FIG. 3. This radial expansion of both inserts 150 and member 110 causes disengagement of member 110 (e.g., radially inner surface 114) from radially outer surface 50*c* and expansion of throughbore 112 radially away from tubular member 50. In addition, as packing element 100 is radially expanded in the manner described above, movable members 162 are again retracted back within recesses 164 to avoid interference between members 162 and any fluids or tools that are moved through passage 54, outside of tubular member 50. Further, in some embodiments, release of the packing element 100 in BOP 10 may be accomplished by routing pressurized fluid into port 29 to force piston 40 and packing element 100 to move axially downward within housing 12 in the manner described above.

Various systems and methods may be employed to actuate movable members 162 out from the corresponding recesses 164. Some example actuation systems will now be described; however, these examples are not limiting, and it is contemplated that other actuation systems may be utilized to actuate movable members 162 in extendable tip assemblies 160.

Figure 5:
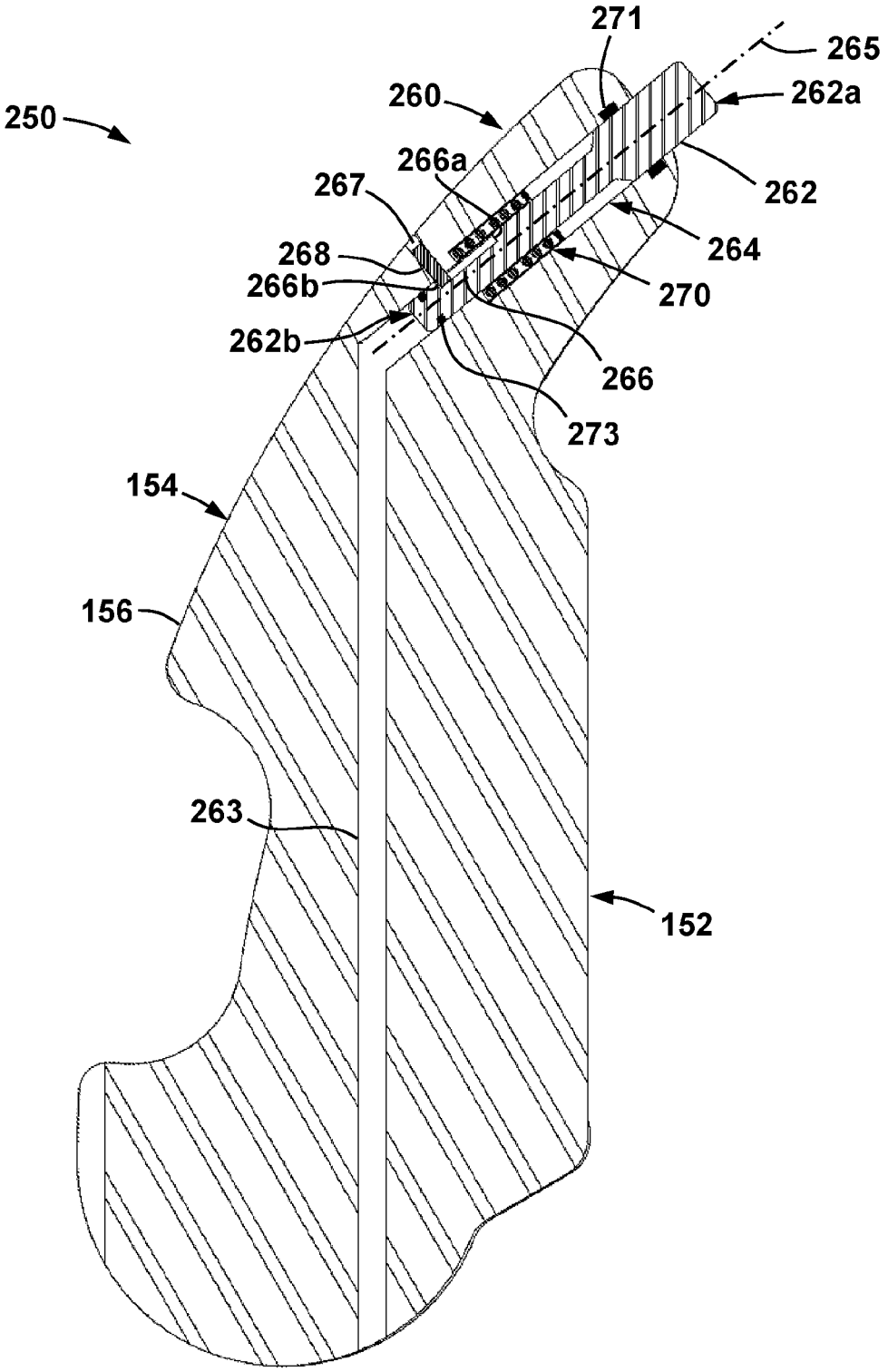
FIG. 5 is an enlarged side cross-sectional view of an embodiment of a rigid insert of the packing element of FIG. 2 in accordance with at least some embodiments.

Referring now to FIG. 5, an embodiment of the rigid insert 250 that may be used within packing element 100 is shown. Rigid insert 250 may be used in packing element 100 in place of one or more inserts 150, previously described. Insert 250 is generally configured the same as inserts 150, previously described, and thus, like features are given like numerals and the description below will focus on the differences between inserts 250, 150. As shown in FIG. 5, insert 250 includes body 152, support section 154, and an extendable tip assembly 260.

Tip assembly 260 includes a recess 264 and a movable member 262 disposed within recess 264. Recess 264 extends within support section 154 along a central axis 265 that is disposed at a non-zero angle with respect to axis 105 and intersects a plane including axis 105 (see FIG. 2). Movable member 262 includes a first or outer end 262*a* extending out from recess 264, a second or inner end 262*b* disposed within recess 264, and a longitudinal slot 266 extending axially with respect to axis 265 between ends 262*a*, 262*b*. Slot 266 includes a first end 266*a* and a second end 266*b* axially opposite first end 266*a*. First end 266*a* is disposed more proximate outer end 262*a* of member 262 than second end 266*b*, and second end 266*b* is disposed more proximate inner end 262*b* of member 262 than first end 266*a*. A fluid passage 263 extends through body 152 and support section 154 and is in communication with recess 264. As will be explained in more detail below, passage 263 receives pressurized fluid (e.g., hydraulic fluid) from a source (not shown) to actuate movable member 262 along axis 265 during operations.

A first seal assembly 271 is disposed between movable member 262 and recess 264 proximate outer end 262*a*, and a second seal assembly 273 is disposed between movable member 262 and recess 264 proximate inner end 262*b*. First seal assembly 271 is configured to prevent or restrict fluid from flowing between recess 264 and central passage 54 of housing 12 and second seal assembly 273 is configured to prevent or restrict fluid from flowing between fluid passage 263 and recess 264 (specifically, the portion of recess 264 occupied by movable member 262). In this embodiment, seal assemblies 271, 273 are each wiper seals—with first seal assembly 271 including a wiper seal seated within the inner wall of recess 264 and second seal assembly 273 including a wiper seal seated within the outer surface of movable member 262. However, it should be appreciated that any suitable sealing assembly or device may be used for sail assemblies 271, 273. During operations, seal assemblies 271, 273 maintain sealing contact with member 262 and recess 264, respectively, as movable member 262 actuates along axis 265.

A locking member 268 is disposed within a recess 268 extending within support section 154 in a direction that is perpendicular to axis 165. As shown, locking member 268 is seated within slot 266 such that axial travel of member 262 along axis 165 is limited by engagement of locking member 268 with the axial limits (i.e., the ends 266*a*, 266*b*) of slot 266 during operations. It should also be appreciated that other locking devices may be used to ensure movable member 262 does not completely withdrawal outer of recess 264, such as, for example, pins, locking dogs, taper locks, etc. In addition, a bearing member 270 is disposed within recess 264 about movable member 262. Bearing member 270 supports and facilitates axial movement of member 262 within recess 264 along axis 265 by reducing friction therebetween during operations. Bearing member 270 may comprise any suitable bearing which reduces friction between moving components, such as, for example, bearings including rollers, spheres, magnets, fluid, etc. In some embodiments, a low friction surface treatment is applied to interacting surfaces of recess 264 and member 262 to reduce friction either in place of or in addition to bearing member 270.

During operations, as elastomeric member 110 of packing element 100 is being deformed both radially and axially with respect to axes 15, 105 under the compressive force applied by piston 40 (see FIGS. 3 and 4), high pressure fluid is routed through passage 263 to increase the pressure on inner end 262*b* of movable member 262. Once the pressure acting on inner end 262*b* is higher than any pressures operating on outer end 262*a* (i.e., pressure within passage 54), member 262 is actuated or moved along axis 265 out of recess 264 until either the pressures acting on ends 262*a*, 262*b* are equalized or the locking member 268 engages or abuts end 266*b* of slot 266 in member 262. Upon the lowering or release of fluid pressure within chamber 263 (e.g., when the pressure within chamber 263 is lower than the pressure acting on outer end 262*a*), member 262 translates axially toward recess 264 until locking member engages or abuts end 266*a* of slot 266.

Figure 6:
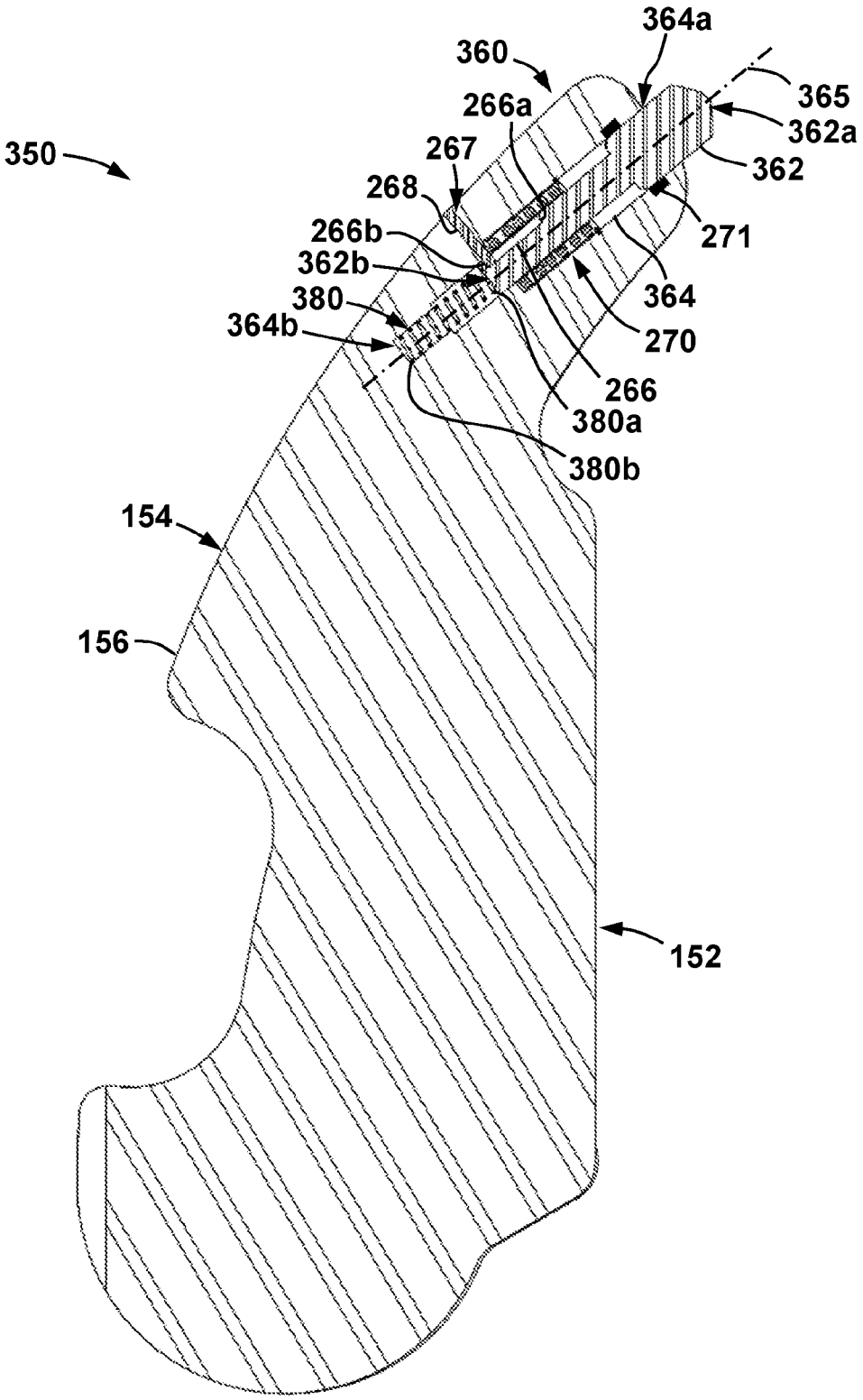
FIG. 6 is an enlarged side cross-sectional view of another embodiment of a rigid insert of the packing element of FIG. 2 in accordance with at least some embodiments.

Referring now to FIG. 6, another embodiment of the rigid insert 350 that may be used within packing element 100 is shown. Rigid insert 350 may be used in packing element 100 in place of one or more inserts 150, previously described. Insert 350 is generally configured the same as inserts 150, 250, previously described, and thus, like features are given like numerals and the description below will focus on the differences between insert 350 and inserts 150, 250. As shown in FIG. 6, insert 350 includes body 152, support section 154, and an extendable tip assembly 360.

Tip assembly 360 includes a recess 364 and a movable member 362 disposed within recess 364. Recess 364 extends within support section 154 along a central axis 365 that is disposed at a non-zero angle with respect to axis 105 and intersects a plane including axis 105 (see FIG. 2). In addition, recess 364 includes a first or outer end 364*a* and a second or inner end 364*b* opposite outer end 364*a*. Movable member 362 includes a first or outer end 362*a* extending out from recess 364, a second or inner end 362*b* disposed within recess 364, and longitudinal slot 266 extending axially with respect to axis 365 between ends 362*a*, 362*b*. Slot 266 is substantially the same as previously described and thus includes a first end 266*a* and a second end 266*b* axially opposite first end 266*a*. A locking member 268, being the same as previously described in disposed within a recess 267 extending perpendicularly to axis 365 and engages with ends 266*a*, 266*b* of slot 266 in the same manner as described above to limit axial travel of movable member 362 during operations. In addition, bearing member 270, previously described above for insert 250 (see FIG. 5), is provided within recess 364 about movable member 362 to reduce friction between member 362 and recess 364 and thereby support axial movement of member 362 during operations as previously described above. Further, first seal assembly 271, being the same as previously described above for insert 250 (see FIG. 5) is disposed between recess 364 and movable member 362 to prevent or restrict fluid flow between central passage 54 (see FIG. 1) and recess 364 during operations.

Referring still to FIG. 6, a biasing member 380 is disposed within recess 364 between inner end 362*b* of member 362 and inner end 364*b* of recess 364. Biasing member 380 exerts a force on inner end 362*b* of member 362 that tends to bias member 362 out of recess 364 along axis 365. Member 380 may comprise any suitable member or device for applying a biasing force along axis 365, and in some embodiments may be a coiled spring, a leaf spring, a pneumatic spring, a plurality of disc springs, etc. In this embodiment, biasing member 380 is a coiled spring that extends helically about axis 365 and includes a first end 380*a* and a second end 380*b* opposite first end 380*a*. First end 380*a* bears against inner end 362 of movable member 362 while second end 380*b* bears against inner end 364*b* of recess 364.

During operations, as elastomeric member 110 of packing element 100 is deformed both radially and axially with respect to axes 15, 105 (see FIGS. 3 and 4), biasing member 380 biases movable member 362 out of recess 364 along axis 365 until either the pressures acting on ends 362*a*, 362*b* are equalized or the locking member 268 engages or abuts end 266*b* of slot 266 in member 362. If the pressure exerted on outer end 362*a* of movable member 362 is greater than the pressure exerted on inner end 362*b* as a result of the biasing force applied by member 380 (e.g., when outer end 362*a* engages with radially outer surface 50*c* of member 50 as shown in FIG. 4), member 362 is translated axially 365 toward recess 364 until locking member 280 engages or abuts end 266*a* of slot 266.

Figure 7:
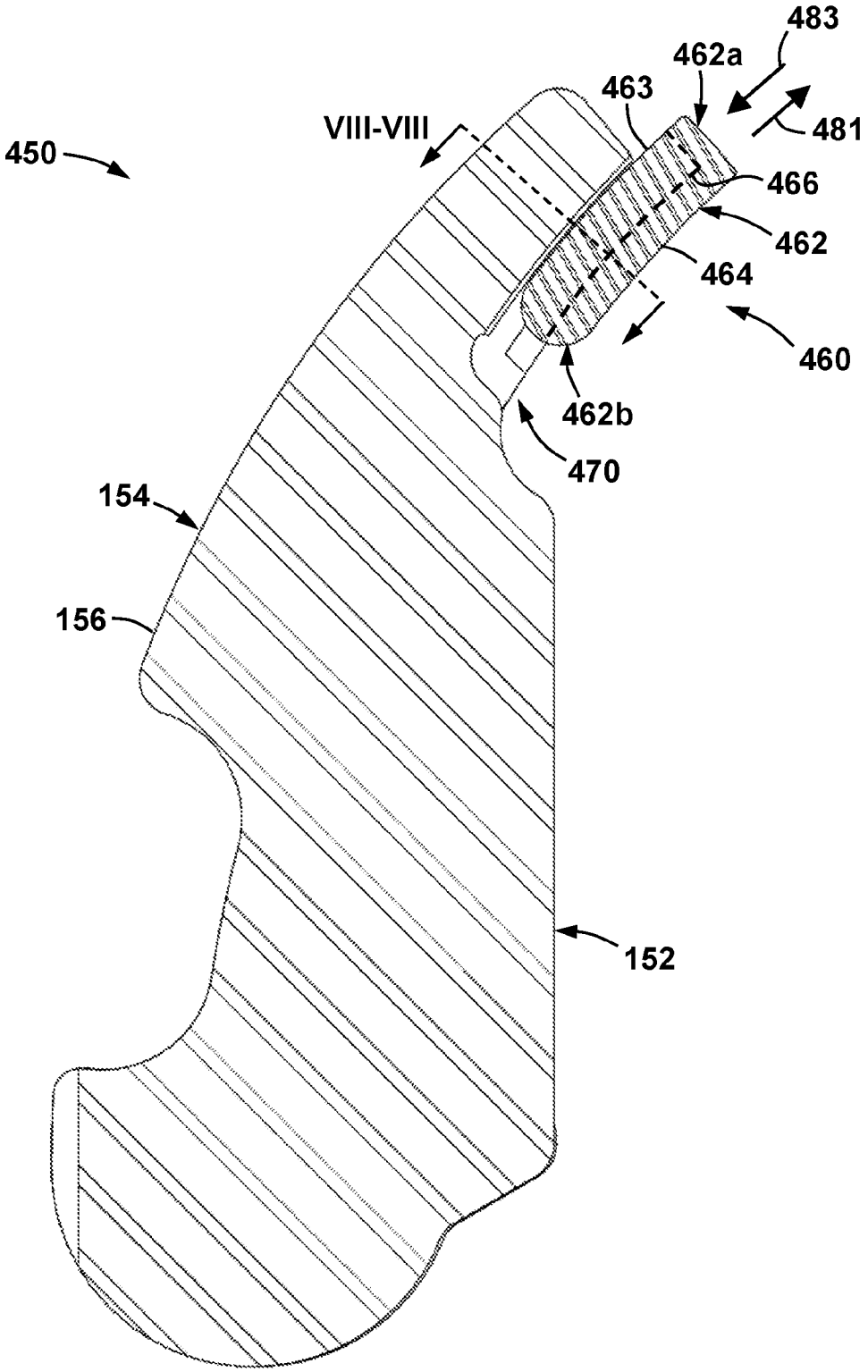
FIG. 7 is an enlarged side cross-sectional view of another embodiment of a rigid insert of the packing element of FIG. 2 in accordance with at least some embodiments.

Referring now to FIG. 7, another embodiment of the rigid insert 450 that may be used within packing element 100 is shown. Rigid insert 450 may be used in packing element 100 in place of one or more inserts 150, previously described. Insert 450 is generally configured the same as inserts 150, 250, 350, previously described, and thus, like features are given like numerals and the description below will focus on the differences between insert 450 and inserts 150, 250, 350.

As shown in FIG. 7, insert 450 includes body 152, support section 154, and an extendable tip assembly 460.

Figure 8:
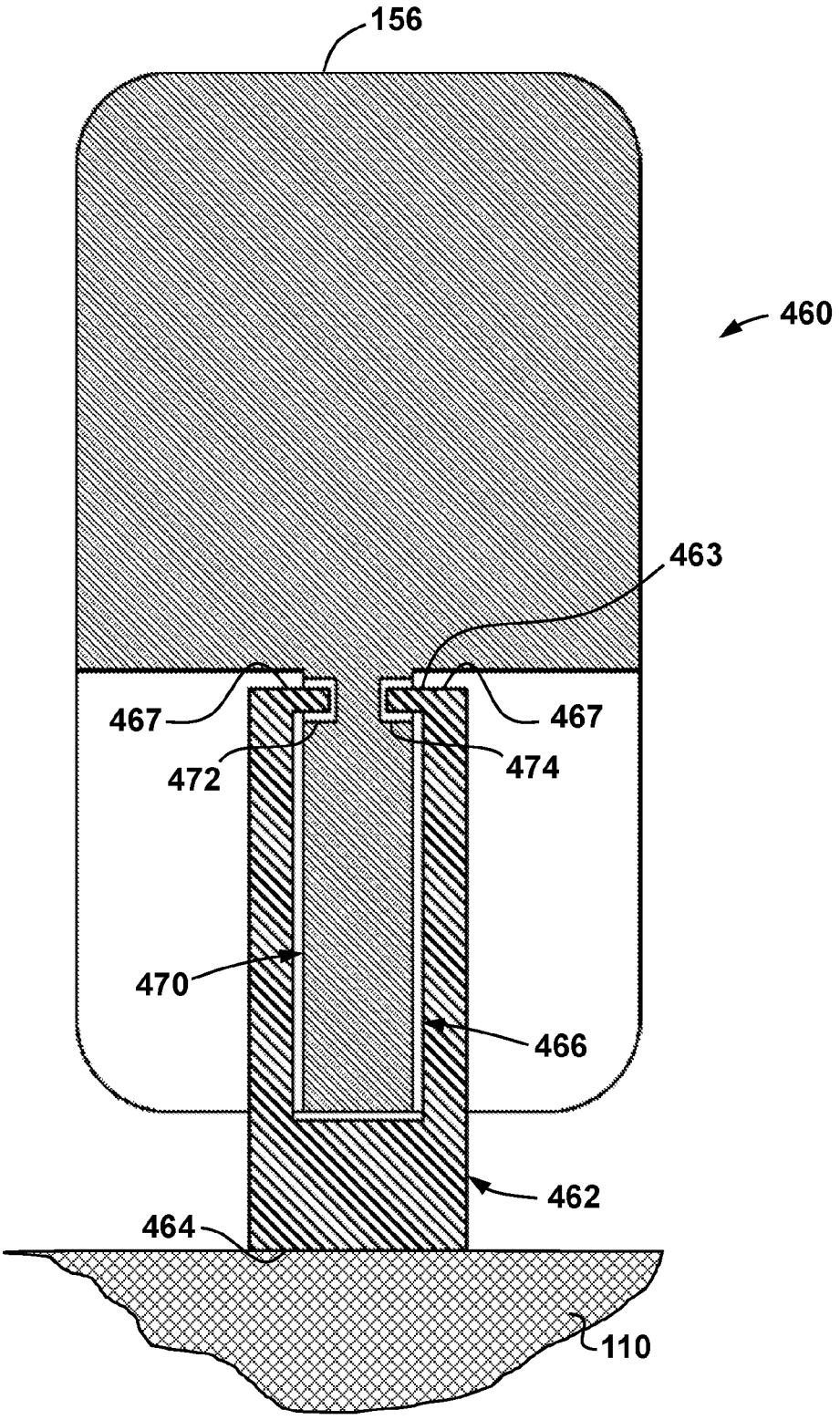
FIG. 8 is a cross-sectional view taken along section VIII-VIII in FIG. 7.

Referring now to FIGS. 7 and 8, tip assembly 460 includes a rail 470 extending along one side of support section 154, and a movable member 462 disposed along rail 470. As is best shown in FIG. 7, movable member 462 includes a first or outer end 462*a*, a second or inner end 462*b* opposite outer end 462*a*, a first elongate surface 463 extending between ends 462*a*, 462*b*, and a second elongate surface 464 also extending between ends 462*a*, 462*b*. First surface 463 faces inward or toward support section 154 of insert 450 and thus may referred to herein as an "inner surface" 463. Conversely, second surface 464 faces outward or away from support section 154 of insert 450 and thus may be referred to herein as an "outer surface" 464.

As is best shown in FIG. 8, movable member 462 also includes a channel 466 extending inward to member 462 from inner surface 463. Channel 466 is sized and shaped to receive rail 270 therein, such that movable member 462 may slide along rail 270 during operations. In this embodiment, rail 470 includes a pair of grooves 472, 474 that each receive one of a pair of mating extensions 467 to secure movable member 462 along rail 470 during operations. However, any other suitable arrangement for securing movable member 462 to rail 470 may be used. As is schematically shown in FIG. 8, elastomeric member 110 is adhered or otherwise secured to at least a portion of outer surface 464 of movable member 462.

Referring still to FIGS. 7 and 8, during operations, as elastomeric member 110 of packing element 100 is being deformed both radially and axially with respect to axes 15, 105 (see FIGS. 3 and 4), movable member 462 is in effect pulled along rail 470 by the movement of elastomeric member 110 as a result of the connection between elastomeric member 110 and surface 464 of movable member 462. Specifically, as piston 40 strokes upward to compress packing assembly 100 as previously described (see FIG. 1), movable member 462 is pulled along a first direction 481 by the movement of elastomeric member 110 (see FIG. 7). Conversely, when piston 40 is withdrawn and packing element 100 is decompressed in the manner previously described (see FIG. 1), movable member 462 is pulled along rail 470 in a second direction 483 that is opposite first direction 481 by the movement of elastomeric member 110.

Figure 9:
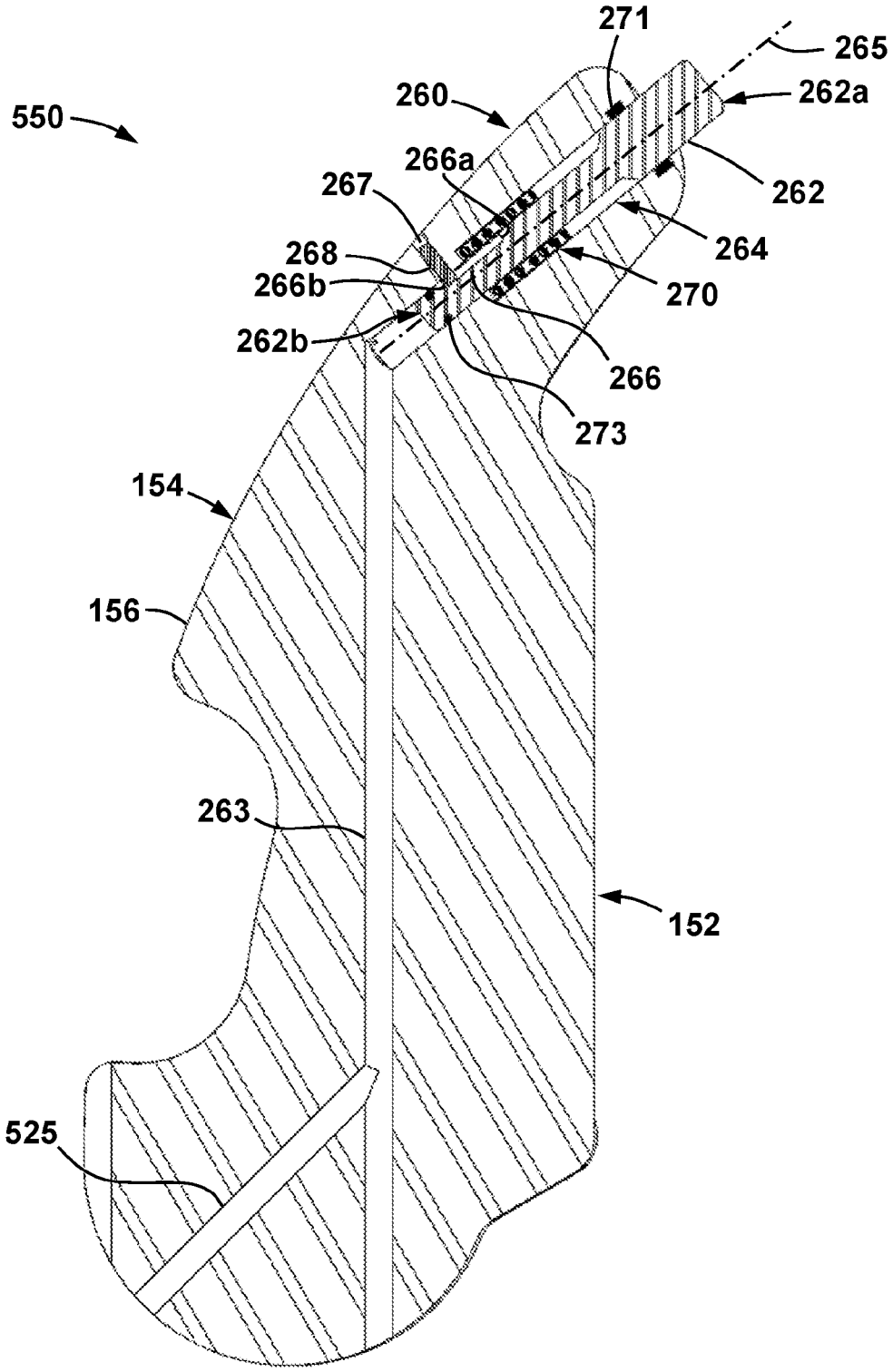
FIG. 9 is an enlarged side cross-sectional view of another embodiment of a rigid insert of the packing element of FIG. 2 in accordance with at least some embodiments.

Some embodiments disclosed herein may actuate a movable member in an extendable tip assembly to provide support for a deforming elastomeric member (e.g., member 110) in a packing element (e.g., packing element 100) by harvesting or utilizing pressures that are typically generated in the central passage (e.g., passage 54) of an annular BOP (e.g., BOP 10). For example, referring now to FIG. 9, another embodiment of the rigid insert 550 that may be used within packing element 100 is shown. Rigid insert 550 may be used in packing element 100 in placed of one or more of the inserts 150, previously described. Insert 550 is generally configured the same as insert 250 previously described, and thus like features are given like numerals and the description below will focus on the differences between insert 550 and insert 250. As shown in FIG. 9, in addition to the features of insert 250, insert 550 further includes an additional internal fluid passage 525 that communicates with passage 263 and places passage 263 and thus recess 264 in fluid communication with the central passage 54 of BOP 10.

Figure 10:
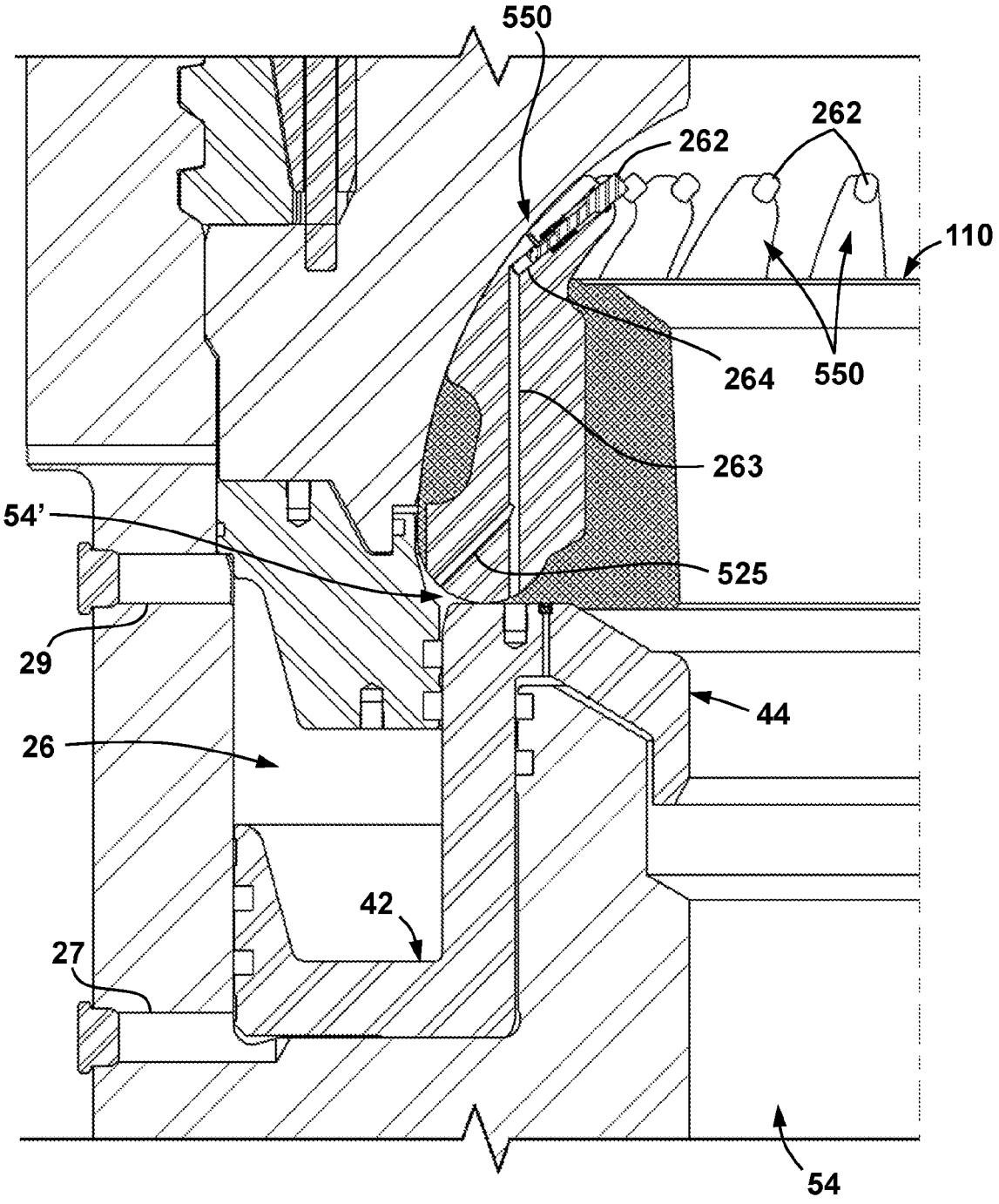
FIG. 10 is an enlarged side cross-sectional view of the packing element of FIG. 2 disposed within the BOP of FIG. 1 and including a plurality of the rigid inserts of FIG. 9.

Specifically, reference is now made to FIG. 10, where member 110 including inserts 550 is shown disposed within BOP 10. As shown, fluid passage 525 places passage 263 and thus recess 264 in fluid communication with a region 54' of passage 54 that is annularly disposed between packing element 100 and adapter ring 36. It has been found that upward axial travel of piston 40 (specifically engagement section 44) during actuation of BOP 10 causes a pressure increase in this region 54' of passage 54. Thus, during an axially upward stroke of engagement section 44 of piston 40, the pressure within region 54' is communicated through fluid passages 525, 263 and acts on inner end 262*b* of movable member 262 to further cause axial translation of member 262 along axis 165 in the same manner as described above for insert 250. As a result, through use of the insert 550, the naturally occurring pressure increase within passage 54 is harnessed to cause actuation of movable members 262 in inserts 550 such that no additional pressurized fluid source is required.

In the manner described, through use of a BOP having a packing element including one or more rigid inserts having extendable tip assemblies in accordance with the principles disclosed herein (e.g., packing element 100 in BOP 10), a length of the rigid inserts may be adjusted to ensure that the elastomeric member (e.g., elastomeric member 110) is fully supported so as to avoid excessive axial deformation and expansion thereof. In addition, through use of a BOP having a packing element in accordance with the principles disclosed herein, the length of the rigid inserts may be adjusted to ensure that any tools or tubular members extending through the BOP are not damaged by impingement with the rigid insert during actuation of the packing element.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. As one example only, while embodiments disclosed herein have shown a BOP 10 and packing element 100 that are actuated to seal off an annulus disposed about a tubular member 50 extending through the BOP 10, it should be appreciated that other packing element 100 may also be actuated to seal off the entire central passage 54 within BOP 10 even when no tubular member 50 or other object is disposed therein.

Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A blowout preventer, comprising:

a housing defining a central passage, wherein the central passage is configured to receive a tubular string therethrough;

a packing element disposed in the central passage, the packing element comprising:

an elastomeric member; and a rigid insert mounted to the elastomeric member, wherein the insert comprises a recess extending along an insert axis and an extendable tip assembly configured to extend a movable member linearly along the insert axis and away from the recess, wherein the movable member comprises a first longitudinal end and a second longitudinal end opposite the first longitudinal end;

wherein the recess and the movable member are aligned along the insert axis and wherein the insert axis extends through both the first longitudinal end and the second longitudinal end of the movable member.

2. The blowout prevent of claim 1, wherein the movable member is configured to engage with and limit deformation of the elastomeric member when the movable member is extended away from the recess.

3. The blowout preventer of claim 2, wherein the housing has a central axis, the central passage is configured to receive a tubular member therethrough along the central axis, and wherein the movable member is configured to limit deformation of the elastomeric member in an axial direction with respect to the central axis.

4. The blowout preventer of claim 1, wherein the first longitudinal end of the movable member is disposed within the recess and the second longitudinal end is disposed outside of the recess, and wherein the extendable tip assembly is configured to extend the second longitudinal end of the movable member away from the recess.

5. A blowout preventer, comprising:

a housing defining a central passage, wherein the central passage is configured to receive a tubular string therethrough;

a packing element disposed in the central passage, the packing element comprising:

an elastomeric member;

a rigid insert mounted to the elastomeric member, wherein the insert comprises an extendable tip assembly configured to extend a movable member away from the rigid insert;

wherein the rigid insert includes a recess, wherein the movable member is at least partially disposed within the recess, and wherein the extendable tip assembly is configured to extend the movable member out of the recess; and wherein the extendable tip assembly is configured to extend the movable member from the recess with hydraulic pressure.

6. The blowout preventer of claim 4, wherein the rigid insert includes an internal fluid passage in communication with the recess and a region of the central passage, and wherein the extendable tip assembly is configured to extend the movable member in response to an increase in pressure within the region of the central passage.

7. The blowout preventer of claim 4, wherein extendable tip assembly is configured to extend the movable member with a biasing member.

8. The blowout prevent of claim 7, wherein the biasing member comprises a coiled spring disposed within the recess.

9. The blowout preventer of claim 1, wherein the movable member is secured to the elastomeric member, wherein the movable member is extended by deformation of the elastomeric member.

10. A packing element for a blowout preventer, the packing assembly comprising:

an elastomeric member;

a rigid insert mounted to the elastomeric member;

wherein the rigid insert includes a recess extending along an insert axis and an extendable tip assembly configured to extend a movable member linearly along the insert axis, wherein the movable member comprises a first longitudinal end and a second longitudinal end opposite the first longitudinal end;

wherein the recess and the movable member are aligned along the insert axis and wherein the insert axis extends through both the first longitudinal end and the second longitudinal end of the movable member; and wherein the movable member is configured to limit deformation of the elastomeric member.

11. The packing element of claim 10, wherein the elastomeric member extends annularly about a central axis, and wherein the extendable tip assembly is configured to extend the movable member away from the recess to limit deformation of the elastomeric member in an axial direction with respect to the central axis.

12. The packing element of claim 10, wherein the first longitudinal end of the movable member is disposed within the recess and the second longitudinal end is disposed outside of the recess, and wherein the extendable tip assembly is configured to extend the second longitudinal end of the movable member away from the recess.

13. The packing element of claim 12, wherein the extendable tip assembly is configured to extend the movable member with hydraulic pressure.

14. The packing element of claim 12, wherein the extendable tip assembly is configured to extend the movable member with a biasing member.

15. The packing element of claim 14, wherein the biasing member comprises a coiled spring disposed within the recess.

16. The packing element of claim 11, wherein the movable member is secured to the elastomeric member, wherein the movable member is extended by deformation of the elastomeric member.

17. The packing element of claim 10 wherein the rigid insert includes an internal fluid passage in communication with the recess, and wherein the extendable tip assembly is configured to extend the movable member in response to an increase in pressure in the internal passage.

18. The blowout preventer of claim 5, wherein the rigid insert includes an internal fluid passage in communication with the recess and a region of the central passage, and wherein the extendable tip assembly is configured to extend the movable member in response to an increase in pressure within the region of the central passage.

19. The blowout preventer of claim 5, wherein the extendable tip assembly is configured to extend the movable member with a biasing member.

20. The blowout preventer of claim 19, wherein the biasing member comprises a coiled spring disposed within the recess.

21. The blowout preventer of claim 1, wherein the recess is defined by an inner surface of the rigid insert which extends entirely about the movable member.

22. The packing element of claim 10, wherein the recess is defined by an inner surface of the rigid insert which extends entirely about the movable member.

* * * * *